United States Patent [19]

Watrous et al.

[11] 4,093,909

[45] June 6, 1978

[54] METHOD AND APPARATUS FOR OPERATING A SEMICONDUCTOR INTEGRATED CIRCUIT AT MINIMUM POWER REQUIREMENTS

[75] Inventors: Donald L. Watrous; Daniel W. Dobberphul, both of Liverpool, N.Y.

[73] Assignee: General Electric Company, Schenectady, N.Y.

[21] Appl. No.: 707,278

[22] Filed: Jul. 21, 1976

[51] Int. Cl.[2] ..... G05F 1/56

[52] U.S. Cl. ..... 323/22 R; 307/297; 307/304; 307/64

[58] Field of Search ..... 321/2; 323/8, 17, 22 R, 323/DIG. 1; 307/304, 297, 44, 45, 46, 64, 66, 72; 363/77, 80

[56] References Cited

U.S. PATENT DOCUMENTS

| | | | |
|---|---|---|---|
| 3,508,084 | 4/1970 | Warner, Jr. | 323/22 R |
| 3,832,644 | 8/1974 | Nagata et al. | 323/22 R |
| 3,913,026 | 10/1975 | Koehler | 323/22 R |
| 4,020,367 | 4/1977 | Yamashiro et al. | 307/297 |

FOREIGN PATENT DOCUMENTS

| | | | |
|---|---|---|---|
| 242,982 | 9/1969 | U.S.S.R. | 323/DIG. 1 |

OTHER PUBLICATIONS

"Ion-Implanted Comp. MOS Transistors In Low-V Ckts" by Swanson, IEEE J Solid State Ckts vol. SC-7, No. 2, Apr. 1972.

"Two-Switching Regs. for Battery-Powered Systems" by S. W. Billingsley et al., EDN/EEE Feb. 15, 1972, pp. 40–43.

Delco Electronics Appl. Note 42; Dec. 1968 "28 Volt Flyback Switching Reg.".

IBM Tech Disc Bulletin, vol. 17, No. 3, Aug. 1974, pp. 937, 938 relied upon.

Electronic Designs Mar. 1, 1976, pp. 62–64.

*Primary Examiner*—Gerald Goldberg

*Attorney, Agent, or Firm*—Marvin Snyder; Joseph T. Cohen; Julius J. Zaskalicky

[57] ABSTRACT

A method and apparatus for operating a smiconductor integrated circuit at minimum power from a voltage source, including deriving a semiconductor process parameter dependent reference voltage within the integrated circuit, comparing the magnitude of the reference voltage and the voltage source and maintaining the magnitude of the voltage source greater than the reference voltage.

10 Claims, 2 Drawing Figures

Figure 1:
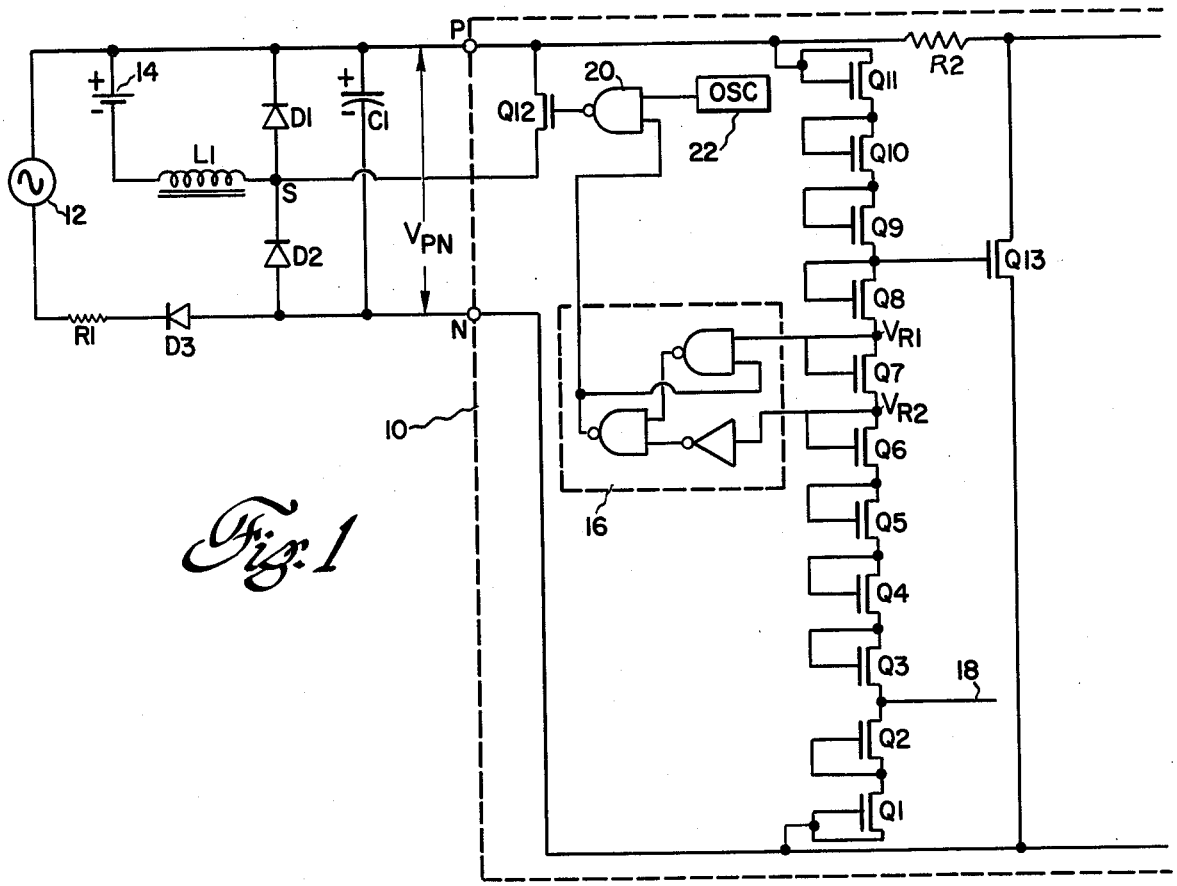

METHOD AND APPARATUS FOR OPERATING A SEMICONDUCTOR INTEGRATED CIRCUIT AT MINIMUM POWER REQUIREMENTS

The present invention relates to semiconductor integrated circuits and more particularly to a method and apparatus for operating such circuits at minimum power.

Many electronic systems are required to operate continuously, even in the event of power system failures. Where such requirements exist, batteries are frequently used as the alternate source of power. However, since the cost and inconvenience of battery replacement may be a significant factor in system design, there is generally a strong desire to limit the battery to a single cell and further to maximize the battery lifetime by minimizing the load requirements. Also, there is frequently a need for voltage levels different from that provided by the most cost-effective battery. Accordingly, DC to DC converters may be required. In such systems, the problem is then to achieve maximum operating time for a given battery-converter-load combination.

Attempts to achieve maximum operating times are obviously dependent on the electronic circuit functions to be provided. However, the maximum operating time is also dependent on the power required by the electronic components employed. Clearly, semiconductor devices require less power than vacuum tube devices. However, even among semiconductor devices there is a considerable variation in power requirements, even from one device to another of the same kind. For example, the power required by functionally identical semiconductor integrated circuits may vary because of component and process variations during circuit fabrication. Where such circuits are used in the aforementioned environment, the customary prior art solution has been to design the power source with sufficient capability to operate the circuits at low battery voltage and with worst case tolerance conditions in the converter and load. Unfortunately, this approach results in inefficiency and reduced battery lifetime since, on the average, most circuits are operating at higher than minimum required power.

It is therefore an object of this invention to provide a method and apparatus for operating an electronic system including semiconductor integrated circuits at minimum power from a voltage source.

It is yet another object of this invention to provide a method and apparatus for maximizing the battery lifetime of a battery-powered semiconductor integraged circuit.

Briefly, these and other objects of the invention are achieved in accordance with one embodiment thereof wherein a battery-powered DC to DC converter for operating a semiconductor integrated circuit is controlled in response to a signal from the integrated circuit such that the power supply voltage (and power) input to the integrated circuit is maintained at a minimum value, sufficient to provide reliable operation thus minimizing current drain from the battery. In accordance with one embodiment of the invention, a DC to DC converter including a charge storage capacitor for providing power to the semiconductor integrated circuit and means for comparing the magnitude of the voltage on the capacitor with a reference voltage, the magnitude of which is dependent upon the process parameters of the integrated circuit. Whenever the magnitude of the voltage on the capacitor is less than the reference voltage, the converter is rendered operative for a sufficient period of time to recharge the capacitor so that a minimum acceptable voltage is maintained to energize the integrated circuit. Since the minimum acceptable supply voltage for an integrated circuit is process parameter dependent, the use of a reference signal based on this parametric dependence derived from the integrated circuit itself insures reliable circuit operation while minimizing the power consumed by the circuit.

Figure 2:
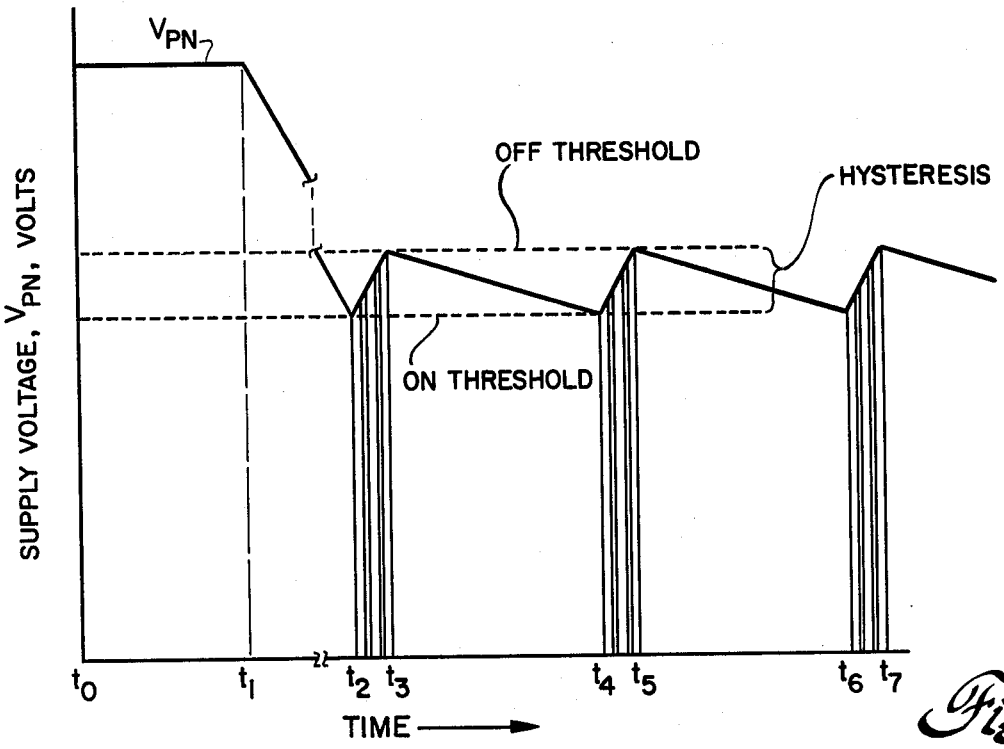

The novel features believed characteristic of the invention are set forth in the appended claims. The invention itself, together with further objects and advantages thereof, may best be understood by reference to the following detailed description taken in conjunction with the accompanying drawings in which:

FIG. 1 is an electrical schematic diagram of an embodiment of the invention illustrating a DC to DC converter operable in conjunction with a semiconductor integrated circuit; and FIG. 2 illustrates the variation in supply voltage as a function of time.

FIG. 1 illustrates an embodiment of the invention comprising a semiconductor integrated circuit 10 powered from a source of voltage $V_{PN}$ derived from either an AC voltage source 12 of from a DC voltage source 14, illustrated as a battery. Under normal operating conditions, the voltage source 12 is halfwave rectified through a diode D3 and the negative voltage excursions of the voltage source 12 are used to charge a capacitor C1 to the voltage $V_{PN}$. Resistor R1 serially connected between the voltage source 12 and the diode D3 provide appropriate current limiting for the charging voltage.

In the event of an AC power failure, the DC voltage source 14 provides the necessary voltage and current for operating a DC to DC converter, such as the flyback converter illustrated in FIG. 1 and comprising an inductor L1, diodes D1, D2 and an ON/OFF switching device illustrated as transistor Q12 comprising a portion of the integrateed circuit 10. As will be described more fully below, the DC to DC converter provides the necessary charging current to maintain the voltage $V_{PN}$ at an acceptable value.

FIG. 1 also illustrates the integrated circuit 10 including a voltage divider comprising transistors Q1 through Q11 connected in electrical series relationship as illustrated in the drawing. Transistors Q1 and Q2 are enhancement mode devices and Q3 through Q11 are depletion mode devices. The function of the voltage divider comprising transistors Q1 through Q11 is to provide a voltage reference signal which is a semiconductor process parameter-dependent voltage.

More specifically and as is well known to those skilled in the art, the operating characteristics and particularly the threshold voltage of metal-oxide-semiconductor field-effect transistors (MOSFETS) varies from semiconductor chip to semiconductor chip due to tolerances in the physical parameters of semiconductor processing. For example, whereas the threshold voltage for an enhancement mode field-effect transistor may be approximately 1 volt on one semiconductor chip, it may be 2 or 2½ volts on another semiconductor chip. Since this variation in threshold voltage must be considered by the circuit designer to insure reliable circuit operation independently of this threshold variation, the resulting design generally accommodates worst case tolerance conditions. However, as pointed out above this approach results in inefficiency because the converter and integraged circuit are generally operating at higher than minimum required power. In accordance with the present invention, transistors Q1 and Q2 provide a process parameter dependent voltage drop at a nodal point 18 which is divided among the remaining transistors Q3 through Q11, which function as linear resistive elements. In this way, the reference voltage is obtained which is process parameter-dependent and having a magnitude selected by the particular connection to one of the gate electrodes of transistors Q3 through Q11. By way of example, the voltage reference $V_{R1}$ is illustrated as being derived from the source electrode of transistor Q7 and $V_{R2}$ from the source of Q6.

The integrated circuit 10 also includes a latch circuit 16 connected to two points, $V_{R1}$ and $V_{R2}$, in the serial arrangement of linear resistive elements, Q1 through Q11. This latch circuit provides hysterisis for the ON/-OFF switching of the converter. The output of latch 16 is connected to one input of a two-input logic gate 20, the other of which is connected to an oscillator 22.

During normal operation, the capacitor C1 is charged from the AC source 12 through the resistor R1 and diode D3. As illustrated in FIG. 2, the voltage $V_{PN}$ appearing across the capacitor C1 during this time interval, $t_o$ to $t_1$, is greater than the converter ON threshold voltage. At time $t_1$, the source of AC voltage 12 is interrupted, (e.g., and AC power failure), the capacitor C1 begins to discharge (because of continued load requirements of the integrated circuit 10) and the magnitude of the voltage $V_{PN}$ decreases. At some time, $t_2$the voltage $VR_2$ becomes more positive than the switching threshold of the latch thereby enabling the oscillator output signal to control the ON/OFF condition of the switching transistor Q12. The flyback converter is now operative and charging capacitor C1 through diode D2. Diode D1 is a germanium diode, for example, which protects the chip from forward current overshoot from inductor L1. As the converter continues to charge the capacitor Cl, the voltage $V_{PN}$increases in magnitude, as illustrated during the time interval $t_2$ to $t_3$. Due to the hyteresis effect of latch 16, the converter will continue to operate until $VR_1$ is more negative than the switching threshold of latch 16.

Between times $t_3$ and $t_4$, the capacitor C1 again begins to discharge until the voltage $V_{PN}$ becomes less than the converter ON threshold voltage at which time the converter again becomes operative to recharge capacitor C1 during the time interval $t_4$ to $t_5$. The converter thus continues to operate in a cyclic manner to maintain the charge on capacitor C1 above the reference voltage. As those skilled in the art can readily appreciate, as the battery voltage decreases during discharge, the converter will operate an increasing percentage of the time to maintain the voltage $V_{PN}$ above the reference voltage. Upon restoration of the AC power source, the capacitor C1 will recharge to a magnitude above the reference voltage and the converter will remain in the OFF condition.

From the foregoing description, those skilled in the art can readily appreciate that the use of a reference voltage derived from a process parameter-dependent voltage source such as the threshold voltage of the enhancement mode transistors Q1 and Q2, enables the operation of other circuit elements on the same chip to be operated reliably with minimum voltage and hence minimum power consumption. As pointed out above, this feature is particularly significant in an environment where batteries are used as a source of standby power and where the cost and inconvenience of battery replacement is a significant factor.

FIG. 1 also illustrates another feature of the invention, the use of a shunt regulator, Q13 for limiting the magnitude of the voltage across the chip. The shunt regulator Q13 includes a resistor R2 as the voltage dropping element. As illustrated, the gate electrode of the transistor Q13 is connected to the drain electrode of transistor Q9 of the voltage divider. In this way, the clamping voltage of the shunt regulator Q13 is also process parameter-dependent.

For a particular integrated circuit operating from the battery-converter combination illustrated in FIG. 1, the integrated circuit is operated at the minimum voltage at which reliable operation is obtained. Over a large number of such integrated circuits, obviously there will be a statistical distribution of minimum operating voltages. However, the average operating time in the battery mode (utilizing the novel methods and apparatus described herein) will increase beyond that obtained with the normal worst case design approach described above. Further, since battery voltage characterisically decreases as the battery discharges, operating the converter in an ON/OFF mode in response to the minimum supply voltage requirements of the specific semiconductor integrated circuit, the battery operating lifetime is significantly extended.

In summary, described is a novel method and apparatus for operating a battery-converter in an ON/OFF mode such that the power supply voltage derived from the converter is maintained at the minimum value required by the integrated circuit load as determined by a reference voltage derived from the integrated circuit itself.

Although the invention has been described with reference to a specific embodiment, it should be obvious to those skilled in the art that various modifications may be made without departing from the true spirit and scope thereof. For example, whereas the oscillator illustrated in FIG. 1 operates continuously and when enabled by the logic gate 20 determines the duty factor of the converter, and equally viable alternative would include the use of a self-oscillating converter. In this case, the switching transistor Q12 would enable/disable the converter and not determine its operating frequency. Accordingly, the invention can be modified in various ways and the appended claims and intended to cover all such modifications and variations.

What we claim as new and desire to secure by Letters Patent of the United States is:

1. A method for operating a semiconductor integrated circuit at minimum power requirements from a voltage source, said method comprising:

deriving a semiconductor integrated circuit process parameter dependent reference voltage from said integrated circuit;

comparing the magnitudes of said reference voltage and said voltage source; and maintaining the magnitude of the voltage to said integrated circuit at a minimum value required for reliable circuit operation with minimum power consumption in said circuit.

2. The method of claim 1 wherein said voltage source includes a battery and a converter charging a capacitor and the step of maintaining the magnitude of the voltage to said integrated circuit comprises:

operating said converter in an ON/OFF mode to charge said capacitor and increase the voltage thereon greater than said reference voltage.

3. The method of claim 2 wherein said reference voltage is derived from current flowing through a voltage divider including a pair of serially connected enhancement mode field-effect transistors.

4. The method of claim 2 wherein the step of operating said converter includes:

controlling the frequency of said converter by the ON/OFF switching rate of a transistor.

5. The method of claim 4 further comprising the step of: regulating the magnitude of the voltage applied to other semiconductor devices in said integrated circuit.

6. In combination a semiconductor integrated circuit adapted to be powered from a battery and a converter having a charge storage capacitor for providing a filtered DC voltage to said circuit, the improvement comprising:

voltage divider means in said integrated circuit for providing a semiconductor integrated circuit process parameter dependent reference voltage;

comparator means for comparing the magnitudes of said reference voltage and said filtered DC voltage, said comparator means providing an output control signal indicative of the relative magnitudes of said voltages; and switching means operatively connected to said output control signal for enabling said converter to charge said capacitor and maintain the magnitude of said DC voltage at the minimum value required for reliable circuit operation with minimum power consumption in the integrated circuit.

7. The combination of claim 6 wherein said voltage divider means includes a pair of enhancement mode field-effect transistors serially connected together and to a plurality of depletion mode field-effect transistors serially connected together, the threshold voltages of said enhancement mode field-effect transistors providing said process parameter dependent voltage.

8. The combination of claim 7 wherein said switching means includes:

an oscillator;

a logic gate enabled by said output control signal and operatively connected to said oscillator for enabling said oscillator to control the frequency of operation of said converter.

9. The combination of claim 8 wherein said converter operates in an ON/OFF burst mode as controlled by said logic gate to charge said capacitor to the voltage required by said integrated circuit.

10. The combination of claim 9 further comprising a shunt regulator operatively connected to said DC voltage and controlled by a signal from said voltage divider means.

* * * * *